United States Patent [19]

Simo et al.

[11] 4,389,303

[45] Jun. 21, 1983

[54] PROCESS OF CONVERTING HIGH-BOILING CRUDE OILS TO EQUIVALENT PETROLEUM PRODUCTS

[75] Inventors: Thomas Simo, Bad Homburg; Karl-Heinz Eisenlohr, Dreieich, both of Fed. Rep. of Germany

[73] Assignee: Metallgesellschaft Aktiengesellschaft, Frankfurt am Main, Fed. Rep. of Germany

[21] Appl. No.: 212,393

[22] Filed: Dec. 3, 1980

[30] Foreign Application Priority Data

Dec. 12, 1979 [DE] Fed. Rep. of Germany ..... 2949935

[51] Int. Cl.[3] ..... C10G 45/58; C10G 47/34; C10G 49/22

[52] U.S. Cl. ..... 208/107; 208/56; 208/100

[58] Field of Search ..... 208/56, 107

[56] References Cited

U.S. PATENT DOCUMENTS

| | | | |
|---|---|---|---|
| 2,772,218 | 11/1956 | Martin | 208/56 |
| 2,791,541 | 5/1957 | Thompson et al. | 208/56 |
| 2,953,513 | 9/1960 | Langer, Jr. | 208/56 |
| 3,321,395 | 5/1967 | Paterson | 208/107 |
| 3,842,122 | 10/1974 | Wolk et al. | 208/107 |
| 4,252,634 | 2/1981 | Khulbe et al. | 208/107 |
| 4,292,168 | 9/1981 | Derbyshire et al. | 208/56 |
| 4,294,686 | 10/1981 | Fisher et al. | 208/56 |

FOREIGN PATENT DOCUMENTS

| | | | |
|---|---|---|---|
| 1095847 | 2/1981 | Canada | 208/107 |

*Primary Examiner*—Delbert E. Gantz
*Assistant Examiner*—O. Chaudhuri
*Attorney, Agent, or Firm*—Sprung, Horn, Kramer & Woods

[57] ABSTRACT

A process for converting high-boiling crude oil having a high content of nondistillable residue which crude oil contains metals and asphaltenes by donor solvent hydrovisbreaking is disclosed wherein the process is carried out near the carbonization temperature limit in the presence of a hydrogen donor. The hydrogen donor can be one derived from the crude itself, from a similar crude oil, or from the distillate product of said donor solvent hydrovisbreaking.

11 Claims, No Drawings

PROCESS OF CONVERTING HIGH-BOILING CRUDE OILS TO EQUIVALENT PETROLEUM PRODUCTS

BACKGROUND OF THE INVENTION

1. Field of the Invention

This invention relates to a process of converting high-boiling crude oils which have high contents, e.g., as high as 70 percent of non-distillable residue, and contain metals and asphaltenes to products similar to petroleum products in the presence of hydrogen donors and of molecular hydrogen at elevated temperature and pressure by donor solvent hydrovisbreaking.

2. Discussion of Prior Art

Heavy crude oils, tars recovered from tar sand, oil shale and the like often cannot be processed with conventional technologies.

If the heavy hydrocarbons have extremely large contents of high-boiling components, asphaltenes, heavy metals and/or elements of the arsenic group, the known processing methods are neither satisfactory nor sufficiently flexible as regards the distribution of yields and the removal of metal.

It has been proposed to process such raw materials by an expensive catalytic hydrogenation in the liquid phase and/or by a de-asphaltization in which asphaltenes are converted or removed, catalyst poisons are separated and products are obtained which can be subjected to known subsequent processing in existing plants. Those proposals involve the disadvantage that the catalytic hydrogenation in the liquid phase incorporates the need of regenerating the catalyst and that this can be accomplished only with great difficulty if the feedstock has extremely high contents of asphaltenes, metals and trace elements. The use of one-way-catalysts involves a loss of catalyst as well as high losses of hydrocarbon oil yields. Additionally the activity of the proposed one-way-catalysts is often inadequate and this can be compensated only by high reaction pressures and temperatures which results in decreases of yield and quality.

It is also known to de-asphaltize the heavy hydrocarbon oil for a recovery of hydrocarbon oils which are substantially free from asphaltenes and can be processed further. Those processes involve the disadvantage that the yields are greatly restricted and an excessively large asphalt fraction is formed which can be used only for a few purposes. Those proposals do not ensure the required removal of metal and trace elements if the feedstock has extremely high contents of asphaltenes, metals and/or other trace elements which constitute catalyst poisons (German Offenlegungsschrift Nos. 2,504,487; 2,504,488; 2,644,721 and 2,726,490).

It is an object of the invention to avoid these disadvantages involved in the prior art and to provide a simple process which can be carried out in a single step, if desired, and in conjunction with a high yield meets the quality requirements set forth.

SUMMARY OF THE INVENTION

This object is accomplished according to the invention in that a hydrovisbreaking treatment is carried out near the carbonization temperature limit without an added catalyst in the presence of hydrogen donors which have been derived from the crude oil itself in the case of a naphthenic crude or from a similar crude oil or from the visbreaker distillate, and the effluent will be subsequently distilled.

The term "carbonization temperature limit," as used herein, refers to the temperature, which causes an agglomeration of the colloidal dispersed asphaltenes at the given temperature gradients and residence time of the feedstock. Generally, the process of the invention is carried out at a temperature about 400°–450° C., preferably 4°–5° C. below such a carbonization temperature limit of e.g. 435° C., actually e.g. at 430° C.

Within the scope of the invention the treatment can be carried out without an addition of solids although it has been found that the treatment can also be carried out in the presence of dispersed solids, for instance, if the starting product inherently contains dispersed solids, as is the case with shale oil. Such solids then serve as supports for asphalt and metal. The solids are present in any amount of between 2 and 20 weight percent, preferably between 5 and 10 weight percent, based on the combined weight of hydrocarbon feedstock and solids.

Within the scope of the invention these supports consist of inert solids of mineral origin which have no catalytic activity.

Solids which may be incorporated include sand fine from tar sand or oil shale fines.

Solids-free or solids-containing heavy oils can be advantageously treated in the donor solvent visbreaking process according to the invention if solids are added which consist or substantially consist of carbon so that the ash content of the visbreaker residue will not be unnecessarily increased. The dispersed carbon solids may suitably consist of coke formed by a coking of the visbreaker residue or derived from coal, wood, peat coconut shells, lignin etc.

Depending on the origin of that coke, it may be partly gasified so that its surface and pore structure are changed in order to achieve an increased adsorption capacity for asphaltenes. Alternatively the coal etc. may be degasified in the presence of activating substances, such as $ZnCl_2$, $SnCl_2$, before it is coked.

The concentration of the dispersed solids in the visbreaker reactor is uniform along the reactor and suitably amounts up to 35% by weight, preferably up to 10% by weight, of the liquid contents of the reactor.

Where these measures are adopted the visbreaking can be carried out in such a manner that the elements of the arsenic groups are completely removed and a satisfactory demetallization is effected whereas losses due to coking need not be feared. It may be desirable in certain cases intentionally to exceed the carbonization temperature limit so that a certain part of the high-molecular asphaltenes adsorbed on the surface of the supports is coked and, as a result, the heavy metals are preferentially deposited. 0.1 to 5% by weight of the total carbon content of the hydrocarbons may be coked.

Donor solvent oil which can be used includes any of the following or mixtures thereof: straight-run distillate boiling 200°–500° C. originating from a naphthenic crude or a donor solvent oil produced by separating a visbreaker distillate, boiling e.g. in the same range.

The donor solvent of any origin comprises naphthenes. The donor solvent oil can be added to the asphalthene and/or metal containing oil in an amount of up to 50 weight percent, based on the combined weight of said oil, said donor solvent and any inert solids which may be present. Generally, the donor solvent oil is present in an amount of at least 10 weight percent; preferably it is present in an amount of between 15 and 50 weight percent, based on the combined weight of the residue which should be converted and said donor solvent oil.

The selected naphthene content of the donor solvent oil may be so high that the cleavage of atomic hydrogen results in a satisfactory decomposition of asphaltene and the removal of the metals is effected in conjunction with a very slight coking and a low extraneous hydrogen consumption, whereas the transformation of the naphthenes to aromatic compounds will not change the dissolving ability of the donor oil for asphaltenes.

According to a preferred further feature of the invention the donor solvent hydrovisbreaking (DSV) is carried out at temperatures of 380° to 480° C. under a total pressure of 40 to 200 bars, preferably 120 to 150 bars, and with a liquid hourly space velocity (LHSV) of 0.5 to 2, preferably 0.8 to 1.5 kg/l-h and a gas circulation ratio of 400 to 2000, preferably 800 to 1200 standard cubic meters per metric ton of the entire liquid feed.

Within the scope of the invention, the donor solvent hydrovisbreaking (DSV) may be carried out in such a manner that part or all of the donor solvent oil is derived from the crude oil or from a similar crude oil or by the straight-run distillation thereof or from the visbreaker distillates produced by the process itself and is not recycled from a succeeding process step.

This measure can be adopted if the crude oil contains more than 20% and preferably more than 40% of naphthenic constituents or if the straight-run distillate fraction obtained from the crude oil and boiling in the range of 200° to 530° C. contains more than 25% and preferably more than 45% naphthenes. In such cases the crude oil or preferably the crude oil fraction boiling above 200° C. is desalted and dewatered, any diluent used for desalting and/or dewatering is distilled or stripped off, and the crude oil is subsequently subjected to hydrovisbreaking.

The process according to the invention may be carried out in such a manner that the visbreaker distillate or its fractions can be recovered in such a quality that they can be used as a donor solvent oil so that such distillates are suitably recycled into the hydrovisbreaker in order to promote the donor effect. This will be applicable to visbreaker distillates or fractions thereof, preferably to fractions boiling in the range of 200° to 530° C., if the naphthene concentration exceeds 20% and preferably 30%.

The heavy high-boiling hydrocarbon oils which can be asphaltenes and/or metals generally have an initial boiling point of at least 200° C. Generally, they boil in the range of 200° to 650° C. They usually have an asphaltene content of at least 1 weight percent, more often at least 5 weight percent, and may have a metal content as high as 2000 ppm.

Under the above stated hydrovisbreaking conditions, the donor solvent hydrovisbreaking can be carried out below the carbonization temperature limit in such a manner that the naphthene concentration in the circulation system and in the hydrovisbreaker remains constant and the crude oil residue is converted to distillable components by a rearrangement of hydrogen so that the object of the process is accomplished. In this way, a donor solvent hydrovisbreaking process is provided which in a single stage converts a naphthene-containing heavy crude oil into stable visbreaker distillates, which are free from metal and asphaltenes and suitable for storage and transportation and can be mixed with straight-run crude oil distillates and can be directly subjected to further processing. In addition, a visbreaker residue becomes available only in a necessary amount, which is used as a fuel for a generation of energy and/or steam or as a raw material for the production of hydrogen.

When the process is intentionally carried out above the carbonization temperature limit, it may be desirable to add solids consisting or substantially consisting of carbon which act as supports by adsorbing the asphaltenes so that the dispersed supporting solids prevent an agglomeration of the resulting coke or a caking of agglomerates on the reactor wall.

These dispersed carbonaceous solids may be derived from the sources stated hereinbefore or from the visbreaker residue itself, which may be coked or partly gasified before it is added to the visbreaker feedstock or may be added to such feedstock without being pretreated.

The donor solvent hydrovisbreaking is generally a process without added, extraneous catalysts. Those solids which may be present inherently or may be added to prevent the coking of asphaltene agglomerates, are not catalytically active.

The visbreaker distillates obtained in accordance with the invention are free from asphaltenes, heavy metals and elements of the arsenic group and may then be processed further in known manner.

The advantages by which the process according to the invention distinguishes from known proposals reside in that the problems involved in the regeneration of the catalyst used for a liquid-phase hydrogenation are eliminated, and further that the yield is not restricted by a loss of oil which is removed in the sludge formed by the one-way-catalyst, and that the conditions under which the donor solvent hydrovisbreaking is carried out are not affected by an inactivation of a catalyst. Moreover, the invention permits an optimum demetallization and removal of trace elements under mild conditions and in conjunction with a minimum extraneous hydrogen consumption. Besides, the yields may be so controlled that visbreaker residue is obtained at the rate which is required for the production of hydrogen and/or refinery fuel purposes.

Further advantages afforded by the process according to the invention in camparison to the known processes reside in that the distillative separation of the residue after hydrovisbreaking rather than the deasphaltization of the crude results in a more reliable demetallization without a restriction of the yield.

The example described hereinafter consists of the single-stage donor solvent hydrovisbreaking of a heavy crude oil. That example does not exclude that the elements of the process according to the invention could be used in other suitable combinations which may be obvious to a person skilled in the art.

EXAMPLE

A Venezuela heavy crude oil was processed in a continuously operated hydrovisbreaker. The conditions of steady-state operation and the properties of the products obtained thereby as well as the yields are stated in Table 1.

In this example, visbreaker distillate boiling in the range of 200° to 530° C. was recycled as an additional donor solvent in a ratio of 100:25 of crude oil to visbreaker distillate.

TABLE 1

| | CO[1] | SRD[2] | VE[3] | VD[4] | VN[5] |
|---|---|---|---|---|---|
| Conditions | | | | | |
| Total pressure, bars | — | — | 140 | — | — |
| Circulating gas standard $m^3$/metric ton of liquid feedstock | — | — | 850 | — | — |
| LHSV of reactor volume, kg/l-h | — | — | 0.95 | — | — |
| Dilution ratio of donor solvent to crude oil, kg/kg | — | — | 25:100 | — | — |
| Yields in % by weight of crude oil | | | | | |
| Naphtha <200° C. | — | — | 19 | — | 19 |
| Distillate, 200–530° C. | 35 | — | 53 | 53 | — |
| Residue, >530° C. | 65 | — | 16 | — | — |
| $C_5^-$ | — | — | 1 | — | — |
| Coking in % of feedstock carbon | — | — | 0.1 | — | — |
| Composition | | | | | |
| Density at 20° C., g/ml | 1.0090 | 0.9227 | 0.9138 | 0.9228 | 0.7511 |
| Sulfur, % by weight | 4.0 | 3.07 | 2.88 | 2.71 | 0.87 |
| Bromine number, g bromine per 100 g | 65 | 53 | 24 | 20 | 53 |
| % of total carbon in aromatic bonds | 26 | 11 | 28 | 26 | — |
| aliphatic bonds | 38 | 42 | 46 | 41 | — |
| naphthenic bonds | 36 | 47 | 26 | 33 | — |

[1]CO = crude oil
[2]SRD = straight-run distillate, 240–530° C.
[3]VE = visbreaker effluent
[4]VD = visbreaker distillate, 200–530° C.
[5]VN = visbreaker naphtha, <200° C.

What is claimed is:

1. A process of converting a high-boiling crude oil having a high content of nondistillable residues, said crude oil containing metals and at least 5 percent of asphaltenes, to equivalent petroleum products which comprises, in a single hydrovisbreaking stage free of catalyst, hydrovisbreaking said high boiling crude oil in the presence of molecular hydrogen and in admixture with a hydrogen donor solvent at a total pressure of 40 to 200 bars, 10 to 50 percent by weight of said mixture being said hydrogen donor solvent, said mixture being at a temperature in the range of 400° to 450° C. and being 4° to 5° C. below the carbonization temperature limit, the hydrovisbreaking conditions comprising a liquid hourly space velocity of 0.5 to 2 and a gas circulation ratio of 400 to 2000 standard cubic meters per metric ton of the entire liquid feed to said hydrovisbreaking stage, withdrawing from said hydrovisbreaking stage a liquid effluent and subjecting said effluent to a distillation, withdrawing from said distillation a residue fraction and at least one distillate fraction, said hydrogen donor solvent being one boiling in the range of 200°–530° C. and being selected from the group consisting of:

(a) a fraction from said crude oil if the crude oil contains more than 20% of naphthenic constituents; or (b) a distillate fraction from said distillation, said fraction having a naphthene concentration exceeding 20%.

2. A process according to claim 1, wherein the process is carried out in the presence of dispersed solids.

3. A process according to claim 1, wherein the feedstock to be processed comprises a heavy hydrocarbon oil which contains inert solids of mineral origin which inert solids do not have catalytic activity.

4. A process according to claim 1, wherein said process is carried out in the presence of dispersed solids and said dispersed solids consist or substantially consist of carbon whereby they act as a support for asphalt and metal in said residue.

5. A process according to claim 1, wherein the process is carried out in the presence of coke.

6. A process according to claim 5, wherein said coke is an activated coke.

7. A process according to claim 1, wherein the process is carried out in the presence of solids, which solids are present in the concentration of up to 35 percent based on the liquid contents in the reactor.

8. A process according to claim 7, wherein said solids are present in the concentration of up to 10 percent by weight based on the liquid contents in the reactor.

9. A process according to claim 1, wherein the process is carried out under a total pressure of 120 to 150 bars employing a liquid hourly space velocity of 0.8 to 1.5 while utilizing a recycled gas ratio of 800 to 1200 standard cubic meters per metric ton of the entire liquid feedstock.

10. A process according to claim 1 wherein said high-boiling crude oil is tar from tar sand and contains solids.

11. A process according to claim 1 wherein said high-boiling crude oil is oil shale which contains solids.

* * * * *